US005282409A

United States Patent [19]

Rojas

[11] Patent Number: 5,282,409

[45] Date of Patent: Feb. 1, 1994

[54] DEVICE FOR SECURING BLADES ON PERFORATION AND CUTTING CYLINDERS FOR GRAPHIC ARTS MACHINERY

[76] Inventor: Manuel J. Rojas, C. Huelva, 19, 08191 Rubi, Barcelona, Spain

[21] Appl. No.: 857,328

[22] Filed: Mar. 25, 1992

[30] Foreign Application Priority Data

Mar. 26, 1991 [ES] Spain ..... 9100972
Mar. 5, 1992 [ES] Spain ..... 9200487

[51] Int. Cl.[5] ..... B26D 1/62

[52] U.S. Cl. ..... 83/698; 83/348; 83/674

[58] Field of Search ..... 83/673, 698, 700, 343, 83/331, 498, 346, 674, 348

[56] References Cited

U.S. PATENT DOCUMENTS

| | | | |
|---|---|---|---|
| 2,088,118 | 7/1937 | Schillo | 83/331 |
| 2,801,694 | 10/1957 | Schneider et al. | 83/698 |
| 3,008,366 | 11/1961 | Taylor, Jr. | 83/346 |
| 3,705,526 | 12/1972 | Bishop | 83/698 |
| 3,951,024 | 4/1976 | Weiskopf | 83/498 |
| 4,594,928 | 6/1986 | Thomas et al. | 83/698 |
| 4,671,154 | 6/1987 | Thomas et al. | 83/698 |
| 4,848,202 | 7/1989 | Crampton | 83/698 |
| 5,119,707 | 6/1992 | Fischer | 83/698 |

*Primary Examiner*—Richard K. Seidel
*Assistant Examiner*—Allen M. Schrock
*Attorney, Agent, or Firm*—Steinberg & Raskin

[57] ABSTRACT

A device for securing blades on perforation and cutting cylinders for graphic arts machinery including two complementary rules which engage together and a pneumatic chamber arranged longitudinally between the two rules. The pneumatic chamber is inflated and causes the rules to separate slightly from each other and compress a blade arranged between at least one of the rules and the walls of a groove of the cylinder in which the device is situated. The pneumatic chamber is connected to a passageway through which a continuous supply of compressed air is provided in order to maintain the pressure in the pneumatic chamber. The device also includes elastic blocks which dampen impacts and noise, and other blocks to prevent regulation screws from loosening.

11 Claims, 4 Drawing Sheets

DEVICE FOR SECURING BLADES ON PERFORATION AND CUTTING CYLINDERS FOR GRAPHIC ARTS MACHINERY

The present invention refers to a device for securing perforation and cutting blades on cylinders of machines for the graphic arts, which device combines extreme simplicity with total efficiency in the securing for which it is designed.

Amongst other objectives, this device also provides a continuous supply of air under pressure and damping of tool impact.

BACKGROUND OF THE INVENTION

The means used to date for securing of the aforesaid blades have involved the use of rules provided with pressure screws placed inside the grooves of the cylinders and compressed between the walls thereof. Securement of the blades by said method was always unsafe and lacking in precision, easily displaced during operation and, therefore, of scant utility and poor performance, as the mechanism had to be adjusted constantly.

Other means used have recourse to the coming together of two rules with complementary inclined planes which slide in relation to each other, and flat opposing planes for support against the walls of the grooves, with interposition of the blades, which rest to the lower side on lips provided for the purpose on said rules, which are provided with depth-graduation screws inside the grooves of the cylinders. An example of such devices is shown in U.S. Pat. No. 4,920,843. In this case, the fixing is safe, but the use of special tools is required for the unlocking and attachment of the assembly, this being mechanically complex to embody and, therefore, expensive.

These embodiments therefore suffer from two essential disadvantages: some are extremely simple and unsafe, while others are mechanically complex and expensive.

DESCRIPTION OF THE INVENTION

The device which is the object of the invention tends to remedy those disadvantages, in that it is of much simpler embodiment than current devices and does not require the use of special tools for its assembly and disassembly, all this without detriment to the capacity of securing the blades, which once placed in correct position can be removed, fitted or replaced without difficulty and without change of the working position initially set in the adjustment operation.

According to the invention, the device, applicable to cylinders having longitudinal grooves in which the blade position securing elements are housed, and provided with screws for regulation of their height with respect to the bottom of the groove and with a support lip for the corresponding tool, is composed of two complementary rules which are engaged together, between which is a longitudinally positioned pneumatic chamber which can be inflated in order to slightly separate said rules from each other and compress the tool at least between one of the rules and the walls of the corresponding cylinder groove.

At least one of these rules is provided with the corresponding support lip and with the depth-position regulating screws, while one of said rules is also provided with a passageway, with flow valve and coupling gasket, into which is inserted a small tubular prolongation of the pneumatic chamber, communicating with the interior thereof, so that it can be inflated and deflated as required.

Said passageway of the corresponding rule is normally angular in shape, communicating with the exterior by one end which opens onto the upper side of the rule and has an inflation valve coupled to it, in such a way as to be easily accessible to the operative, while the other end opens at the inner side of the rule and has the tubular input of the pneumatic chamber hermetically coupled to it.

In a simplified embodiment, one of the rules, which bears the support lip of the corresponding blade and the supporting depth-regulation screws inside the groove, has a rectangular "C" shape and, on the opposite side to the lip is fitted against the other rule, which is flat and is inserted between the horizontal branches of the first rule, so that it is contained along with it inside the aforesaid cylinder groove.

In another variant embodiment, in which both rules are provided with support lips for reception of two blades arranged parallel to each other, and at least one of them is provided with the regulation screws, while the other further has the passageway for coupling it to the inflation valve and to the intermediate pneumatic chamber, one of the rules adopts, as in the previous embodiment, a rectangular "C" shape, while the other one has its coupling edges with the first rule provided with steps into which are inserted the horizontal branches of the shape of the first rule.

In any case, retention of the work blades is effected by inflating the pneumatic chamber fitted between the two rules, which gives rise to strong compression of the rule or rules against the blades positioned between them and the walls of the cylinder groove.

The device of the invention also includes means for the continuous supply of air under pressure within the pneumatic chambers in order to ensure at all times an adequate level of pressure, and means for elastic damping of blade impact on the machine anvil. It also includes means for preventing unscrewing of the regulation screws, which come loose during operation due to vibrations.

For this purpose there is a direct connection for each of the pneumatic chambers, through the respective passageways which link to the chambers and which are connected to a central passageway, which is turn connected to a source for supply of air under pressure.

The mentioned passageways leading to each of the chambers are provided with shutoff cocks which permit them to be isolated independently at a given time, leaving the central passageway and the passageways linked to the pneumatic chambers forming part of a rotor attached to the blade-carrying cylinder.

In a preferred embodiment, the central passageway is formed at the end of the shaft of the blade-carrying cylinder, while from said central passageway set out radially the passageways which, through suitable flexible connections, supply each of the pneumatic chambers.

Advantageously, under each of the depth-regulation screws within the cylinder grooves are provided some elastic blocks which, in addition to damping the blows from the blades on the anvil of the machine to which they are applied, also muffle the noise produced by said blows.

Finally, another of the improvements lies in provision between the pneumatic chamber and the depth-regulation screws of similarly elastic blocks, in contact with and pressing against each other through appropriate orifices formed on the corresponding rule, in such a way that the inflation pressure of the chamber itself also applies pressure to the block against the body of the screw, thus preventing their unscrewing, which is a consequence of the vibrations which are inevitably produced.

BRIEF DESCRIPTION OF THE DRAWINGS

For a better understanding of all that has been set forth, there are attached some drawings in which, schematically and only by way of example, without any restrictive character, two practical examples of embodiment of devices which accord with the construction object of the invention are represented.

In said drawings.

DESCRIPTION OF PREFERRED EMBODIMENTS

Figure 1:
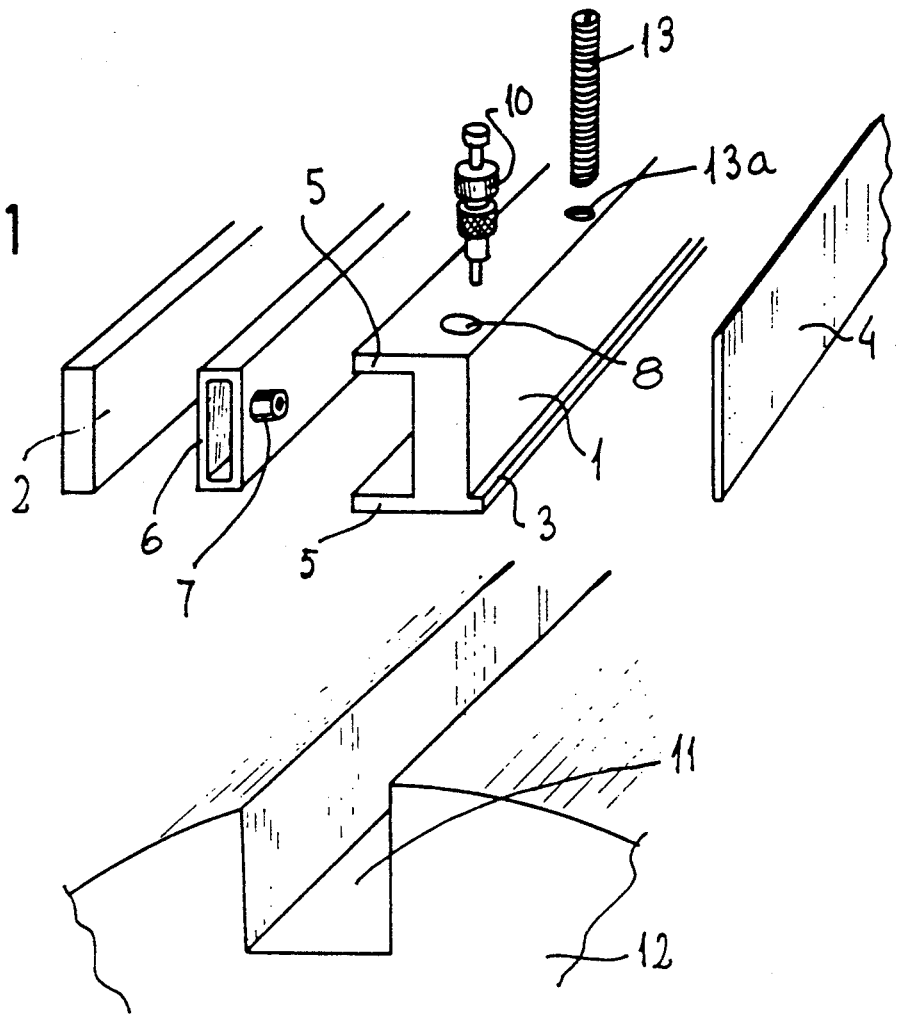
FIG. 1 is a perspective exploded view of a simplified embodiment.
Figure 2:
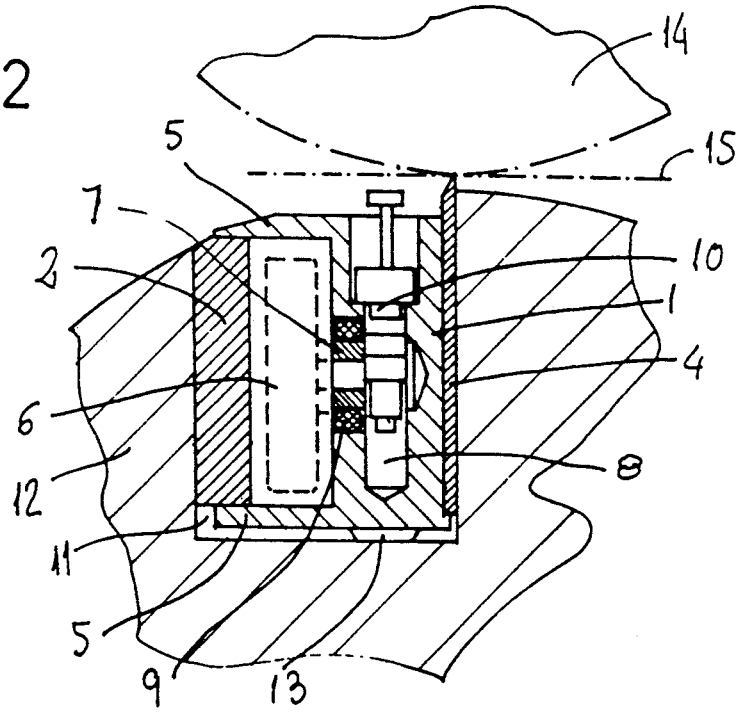
FIGS. 2 and 3 are cross-sectional views of the device of the above embodiment assembled in working position, across planes which pass through that corresponding to the inflation valve and one of the regulation screws.
Figure 3:
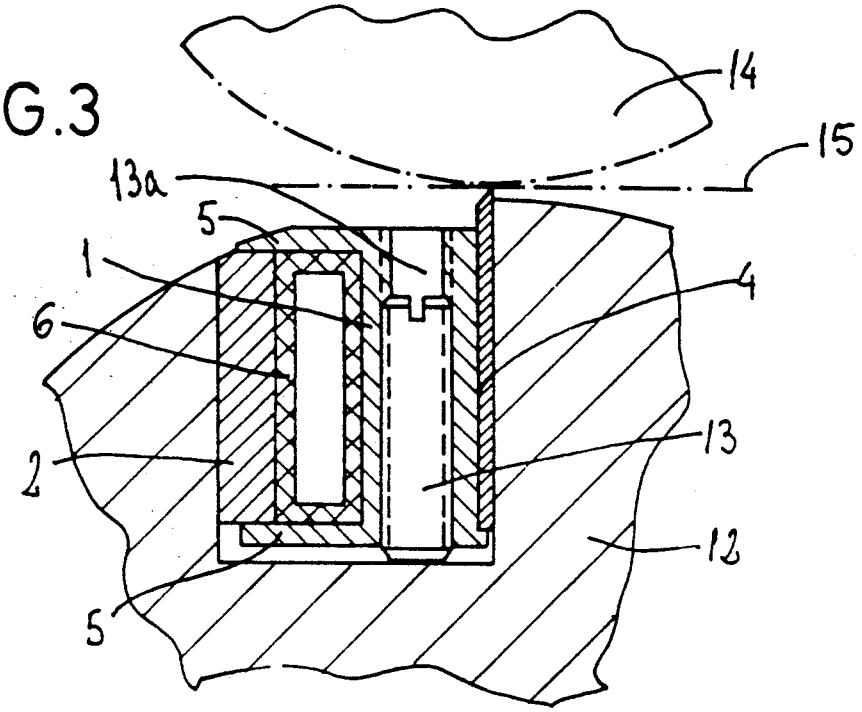

As can be observed in FIGS. 1 to 3, the device is made up essentially of two rules -1- and -2-, the first of which has a rectangular "C" section and is provided with a lip -3- for support of the internal edge of the blade -4-. The other rule -2- is flat and of dimensions suitable for engaging between the horizontal branches -5- of the first rule -1-.

Housed between the horizontal branches -5- of that shape -1-, and advantageously adapted to the outline enclosed by both rules -1-2-, is a pneumatic chamber -6-, with tubular air inlet pin -7-.

This tubular pin -7- faces the inlet of an internal passageway -8- which opens onto the internal side of the rule -1-, to which it is fitted through a sealing gasket -9-. The passageway -8-, which also leads to the exterior through the upper side of the rule -1-, has a valve -10- incorporated, suitable for permitting inflation of that chamber -6-.

The assembly comprising rules -1-2-, pneumatic chamber -6- and blade -4- is housed inside the groove -11-of the blade-carrying cylinder -12-, being adjustable in height or depth by means of the screws -13-, of conventional construction and operation, which penetrate through threaded orifices -13*a*- so that the position of the blade -4- is kept perfectly in contact with the surface of the cylinder-anvil -14-, for perforation or cutting against it of the sheet -15- which is made to pass between said cylinder and the cutting edge of the blade -4-.

Figure 4:
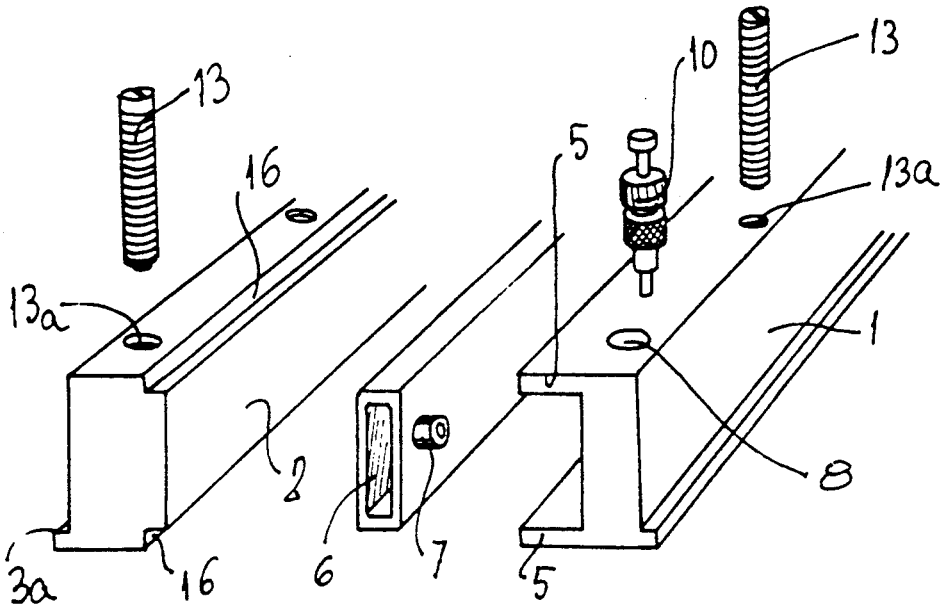
FIG. 4 shows a perspective exploded view of a varient embodiment of the device, for double blade.

In the variant embodiment shown in FIG. 4, the rule -2- is provided with another lip -3*a*- similar to the lip -3- of the rule -1-, in order to support another blade similar to the blade -4-, while its internal side has the longitudinal edges provided with steps -16- of dimensions appropriate for engaging between the horizontal branches -5- of the rule shape -1-. As in the previous case shown in FIGS. 1 to 3, the pneumatic chamber -6- is fitted between the two rules, with similar assembly and operation.

The operating system of the device is the same in both embodiments.

The entire assembly having been placed in the position shown by way of example in FIG. 2, and using a source of air under pressure, air is injected through the valve -10-, so that, as the pneumatic chamber -6- is inflated, it compresses the rule -1- (FIGS. 1 to 3) or both rules -1- and -2- (FIG. 4) against the walls of the groove -11-, the blade -4- being therefore firmly pressed against the walls of the groove -11-. When necessary, the valve -10- itself allows letting out air from the pneumatic chamber -6-, and consequent disassembly of the blade -4-.

As can be seen, no special tool is needed for handling of the rules -1- or -2-, as occurs in the case of known embodiments, since the supply of air under pressure and the consequent outlet of same is sufficient to achieve clamping or release of the blades -4-.

The constructive simplicity of the device described, in any of the embodiments shown or others possible within the scope of the invention, makes it a valuable working element and, most of all, one of extraordinarily low cost.

Figure 5:
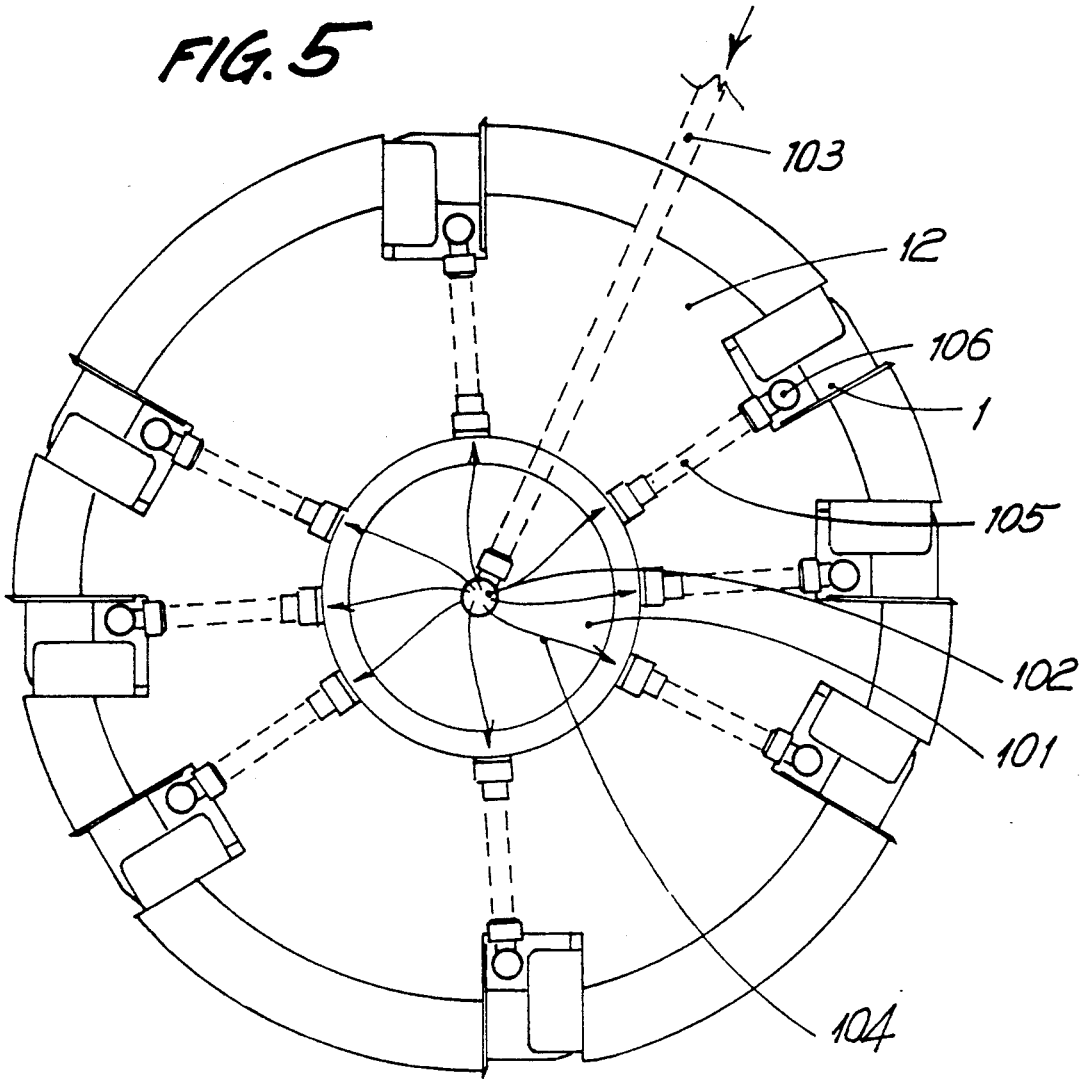
FIG. 5 is an elevation view from the end of the blade-bearing cylinder.
Figure 6:
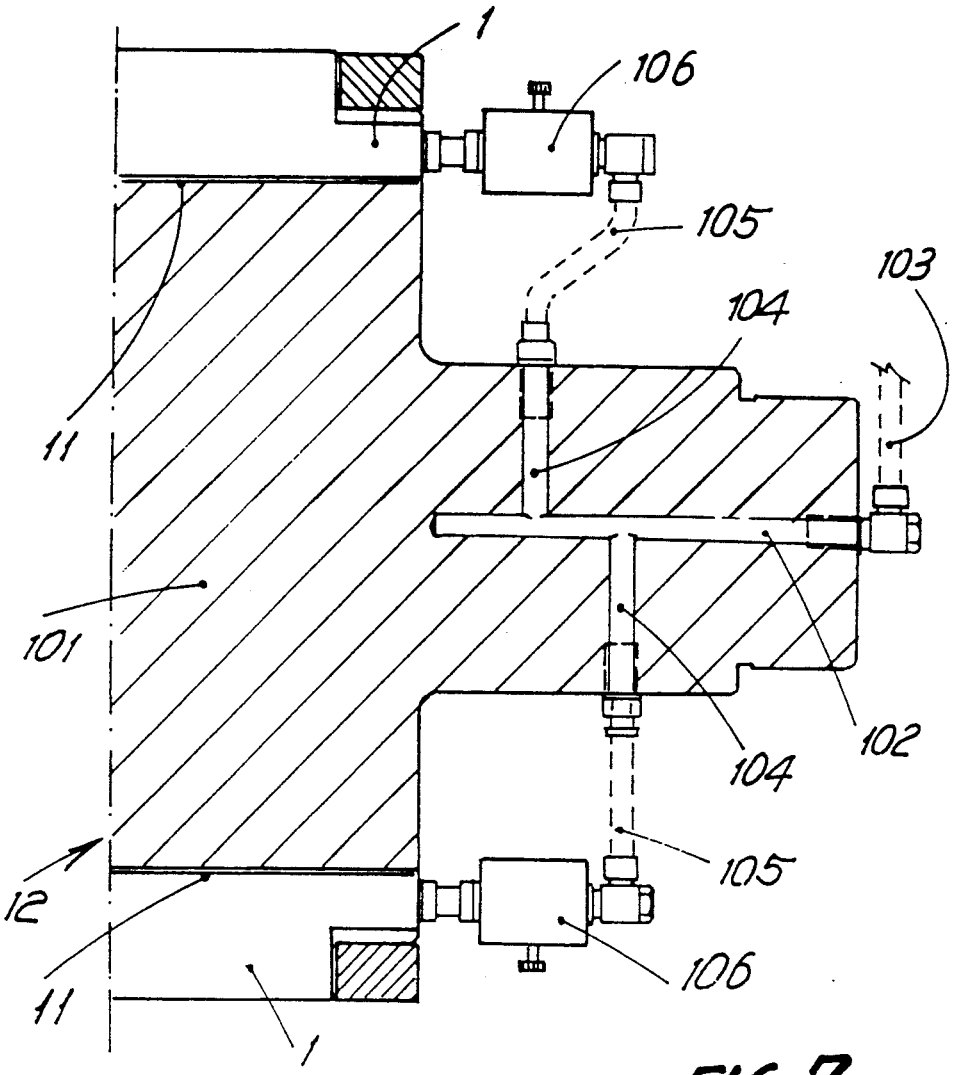
FIG. 6 is an axial section view of the same end of the cylinder.

In the embodiment shown in FIGS. 5 and 6 it can be seen that the shaft -101- of the cylinder -12- is traversed axially by a passageway -102-, which is fed through an external passageway -103- from a source of air under pressure.

From the passageway -102- there emerge a plurality of radial passageways -104- connected to a similar number of flexible conduits -105-, which communicate the passageways -104- with the corresponding pneumatic chambers -6-. At the end where the conduits -105- connect with the chambers -6- there are a similar number of shutoff cocks -106-, which permit the isolation of any of the chambers -6- at any time, without interfering with operation of the others.

Connection with the chambers -6- is carried out through the respective rules -1-.

It can thus be understood that the various chambers -6- can be kept supplied at a constant pressure, without the need for any type of surveillance or periodic refilling, merely by maintaining that pressure in the supply circuit through the passageway -103-.

In the example shown, which as has been stated corresponds to a preferred embodiment, the assembly of passageways for supply of air under pressure is located at the end of the shaft of the cylinder -12-, though it can easily be understood that it could form part of a rotor fitted and coupled suitably on the end of the cylinder itself.

Figure 7:
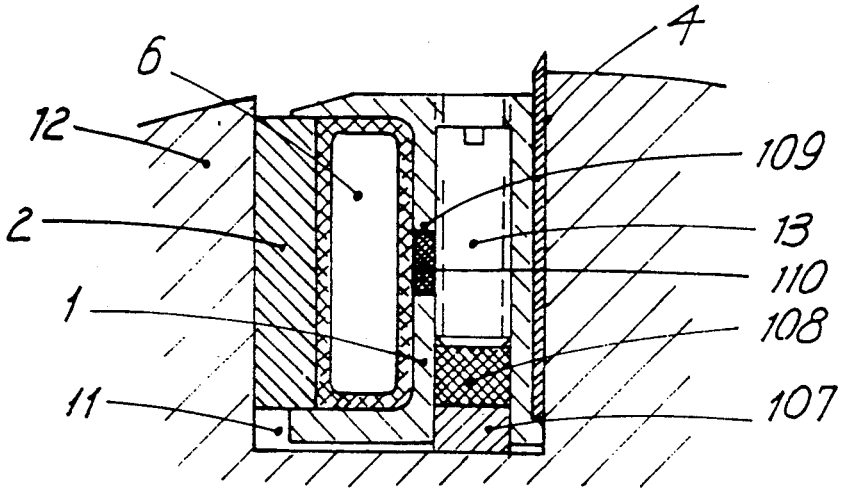
FIG. 7 is a cross-sectional view of a sector of the cylinder which includes one of the grooves, with the assembly of elements contained inside it.

In the detail of FIG. 7 it can be observed that, under the screw -13- for the adjustment of the depth of the assembly inside the grooves -11- of the cylinder -12-, there is a block of elastic material -107-, which rests directly on the bottom of the groove -11-, said block being provided with a head -108- to which is transmitted the pressure of the screw -13-. This block -107-, thanks to its elasticity, absorbs the movements of the assembly produced by the impacts of the blade -4- on the anvil of the machine, thus damping both the shock and the noise produced thereby.

Furthermore, between the pneumatic chamber -6-and the body of the screw -13-, there is provided through an appropriate orifice -109- in the body of the rule -1-, another elastic block -110- which, thanks to the pressure of the chamber -6-, is applied strongly against the screw -13- itself, thus preventing any loosening turning movement of the screw, which might occur as a consequence of the vibrations inevitably produced during the operation.

The embodiments of FIGS. 5, 6 and 7 present the following advantages:

a) no need for periodic refill air under pressure to the chambers -6-;

b) no need for periodic adjustment and repair of the blades -4-;

c) effective damping of the noise and impacts of the blade -4- on the anvil of the machine;

d) perfect locking of the screws -13- in their securement position.

I claim:

1. In perforation and cutting cylinders for graphic arts machinery, a device comprising two separate and complementary rules (1,2) which engage together, a blade, a pneumatic chamber (6) defined by walls disposed between and separate from said complementary rules, said pneumatic chamber being arranged longitudinally between said rules and being inflatable such that said rules separate slightly from each other and compress said blade (4) arranged between one of said rules and walls of a corresponding groove of a cylinder (12).

2. Device, as claimed in claim 1, characterized in that at least one of said rules (1,2) is provided with a corresponding blade support lip (3) and at least one depth-position regulating screw (13), one of said rules (1,2) being provided with a passageway (8), an inflation valve (10) and coupling gasket (9), into which is inserted a small tubular prolongation (7) of the pneumatic chamber (6), communicating with the interior thereof, so that it can be inflated and deflated as required.

3. Device, as claimed in claim 1, characterized in that one of said rules is provided with a passageway (8) which communicates with the exterior of the rule by one end which opens onto an upper side of the corresponding rule (1, 2) and has an inflation valve (10) coupled to it, in such a way as to be easily accessible, while the other end opens on an inner side of the rule and has a tubular prolongation (7) of the pneumatic chamber (6) hermetically coupled thereto.

4. Device as claimed in claim 1, characterized in that both rules (1,2) are provided with support lips (3), for reception of two blades (4) arranged parallel to each other, and at least one of them is provided with at least one regulation screw (13), while the other is further provided with passageway (8) for coupling with an inflation valve and with the pneumatic chamber (6), one of said rules (1) having a rectangular C-shaped section, the opposite rule (2) has coupling edges provided with corresponding steps (16) into which are engaged horizontal branches (5) of the C-shaped section of the first rule.

5. Device, as claimed in claim 1, characterized in that it comprises means for the continous supply of air under pressure to the interior of the pneumatic chambers (6), means for elastic damping of blade (4) impacts, and means for preventing the rotation of at least one regulation screw (13), each of the pneumatic chambers (6) is connected to a source of supply of air under pressure, through respective passageways (104, 105) linked to the chambers and connected to a central passageway (102), which is in turn connected to said source.

6. Device as claimed in claim 5, characterized in that the central passageway (102) is formed on the end of a shaft (101) of the blade-carrying cylinder (12), the passageways (104) are radially spaced and feed each of the pneumatic chambers (6) through flexible connections (105).

7. Device as claimed in claim 5, characterized in that the passageways (104, 105) leading to each of the chambers are provided with shutoff cocks (106) which permit them to be isolated independently at a given time.

8. Device as claimed in claim 5, characterized in that elastic damping blocks (107) are provided under each of the depth-regulation screws (13) within the grooves (11) of the cylinder (12).

9. Device as claimed in claim 5, characterized in that elastic blocks (110) are arranged between the pneumatic chamber (6) and the depth-regulation screws (13) through orifices (109) formed on the corresponding rule (1).

10. Device as claimed in claim 1 wherein said walls of said pneumatic chamber are inserted between said two rules such that said walls of said pneumatic chamber are displaceable against said rules.

11. Device as claimed in claim 1, wherein said pneumatic chamber is structured and arranged to provide a fluid-tight seal and prevent a fluid inflating said pneumatic chamber from leaking.

* * * * *